US012571274B2

(12) United States Patent
Shelton

(10) Patent No.: US 12,571,274 B2
(45) Date of Patent: Mar. 10, 2026

(54) SETTING TOOL ADAPTOR

(71) Applicant: HARRISON JET GUNS II, L.P., Kennedale, TX (US)

(72) Inventor: James F. Shelton, Kennedale, TX (US)

(73) Assignee: HARRISON JET GUNS II, L.P., Kennedale, TX (US)

( * ) Notice: Subject to any disclaimer, the term of this patent is extended or adjusted under 35 U.S.C. 154(b) by 0 days.

(21) Appl. No.: 18/726,612

(22) PCT Filed: Jan. 5, 2023

(86) PCT No.: PCT/US2023/010221
§ 371 (c)(1),
(2) Date: Jul. 3, 2024

(87) PCT Pub. No.: WO2023/133212
PCT Pub. Date: Jul. 13, 2023

(65) Prior Publication Data

US 2025/0092749 A1 Mar. 20, 2025

Related U.S. Application Data

(60) Provisional application No. 63/297,314, filed on Jan. 7, 2022.

(51) Int. Cl.
*E21B 23/04* (2006.01)
*E21B 43/1185* (2006.01)

(52) U.S. Cl.
CPC ..... *E21B 23/0414* (2020.05); *E21B 43/1185* (2013.01)

(58) Field of Classification Search
CPC . E21B 23/0414; E21B 43/1185; E21B 43/119
See application file for complete search history.

(56) References Cited

U.S. PATENT DOCUMENTS

| | | | | |
|---|---|---|---|---|
| 4,266,613 | A * | 5/1981 | Boop | F42D 1/04 200/82 R |
| 4,572,288 | A | 2/1986 | Kinley | |
| 10,036,236 | B1 * | 7/2018 | Sullivan | E21B 43/11855 |
| 10,767,453 | B2 * | 9/2020 | Phelps | E21B 43/1185 |
| 10,914,147 | B2 * | 2/2021 | Sullivan | E21B 43/1185 |
| 11,053,783 | B2 * | 7/2021 | Montoya Ashton | E21B 23/03 |
| 11,353,308 | B2 * | 6/2022 | Lopez De Cardenas | E21B 43/1185 |
| 11,965,393 | B2 * | 4/2024 | Knight | E21B 23/065 |

(Continued)

FOREIGN PATENT DOCUMENTS

CA 3207333 A1 * 2/2024

*Primary Examiner* — Jennifer H Gay
(74) *Attorney, Agent, or Firm* — WARNER NORCROSS + JUDD LLP

(57) ABSTRACT

A setting tool adaptor for attachment to a tandem and a setting tool is provided. The setting tool adaptor includes an ignitor within an ignitor cavity and includes an electrically grounded thermal fuse within a logic cavity. The ignitor is adjacent a power charge in a setting tool, such that the ignitor initiates a combustion of the power charge. Pressure and heat generated by the combustion of the power charge ejects the ignitor into the logic cavity and initiates the thermal fuse to render internal circuitry unreadable, while the adjacent tandem isolates the hot gases from an upstream perforating gun or other upstream tool.

20 Claims, 1 Drawing Sheet

(56) References Cited

U.S. PATENT DOCUMENTS

| | | | | |
|---|---|---|---|---|
| 2013/0043074 | A1 | 2/2013 | Tassaroli | |
| 2017/0051586 | A1* | 2/2017 | Wells | E21B 43/1185 |
| 2019/0136673 | A1 | 5/2019 | Sullivan et al. | |
| 2019/0162057 | A1* | 5/2019 | Montoya Ashton | E21B 43/1185 |
| 2019/0309608 | A1* | 10/2019 | Phelps | F42D 1/05 |
| 2020/0332630 | A1 | 10/2020 | Davis et al. | |
| 2020/0355482 | A1* | 11/2020 | Lopez De Cardenas | E21B 43/117 |
| 2020/0362652 | A1 | 11/2020 | Eitschberger et al. | |
| 2020/0362654 | A1* | 11/2020 | Eitschberger | E21B 23/042 |
| 2022/0099423 | A1* | 3/2022 | Sullivan | F42B 3/10 |
| 2022/0364430 | A1* | 11/2022 | Knight | E21B 23/04 |
| 2023/0193711 | A1* | 6/2023 | Eitschberger | E21B 41/00 |
| 2025/0092749 | A1* | 3/2025 | Shelton | E21B 23/0414 |

* cited by examiner

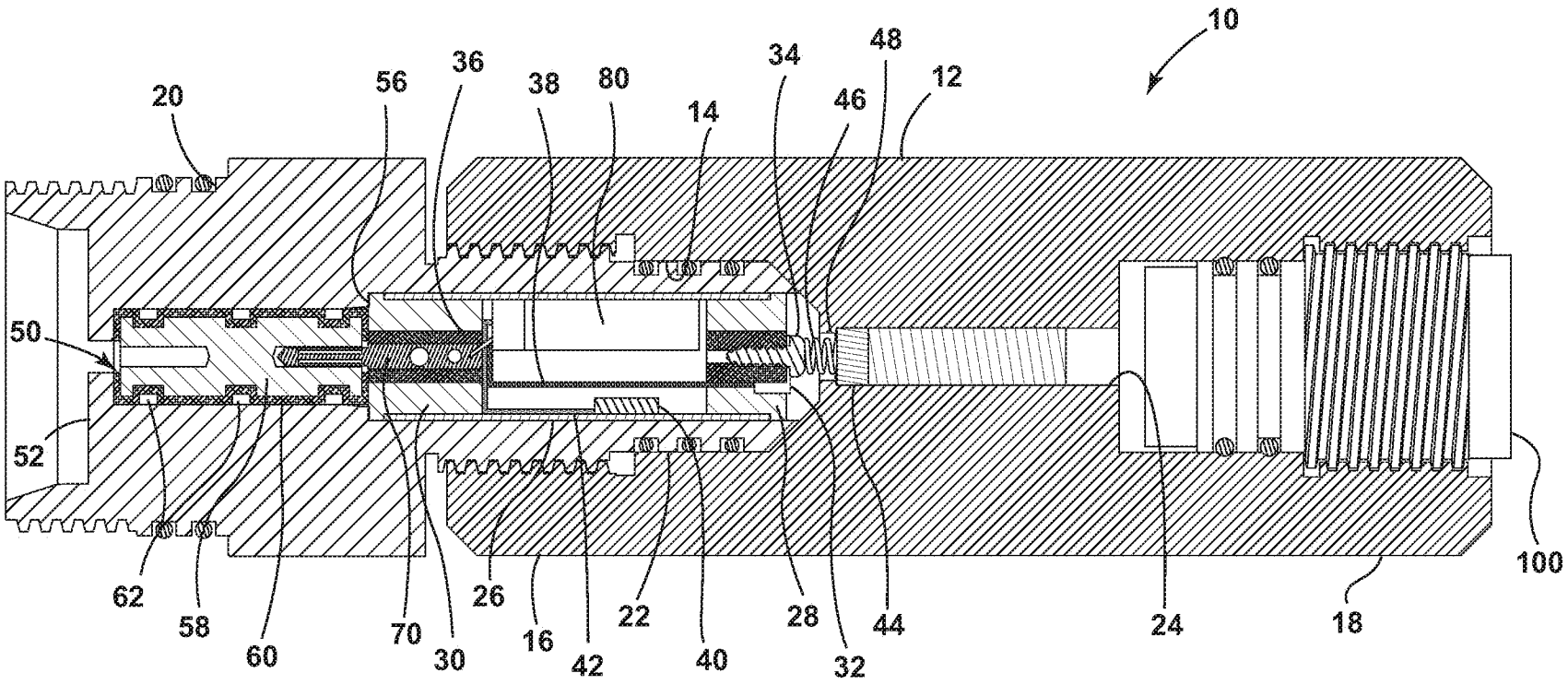
100
18
10
24
12
48
46
34
14
80
38
36
56
20
50
52
62
58
60
70
30
26
16
42
22
40
28
32
44

SETTING TOOL ADAPTOR

CROSS-REFERENCE TO RELATED APPLICATIONS

This application claims the benefit of U.S. Provisional Application 63/297,314, filed Jan. 7, 2022, the disclosure of which is incorporated by reference in its entirety.

TECHNICAL FIELD

The present invention relates to a setting tool adaptor for wellbore completion.

BACKGROUND

In oil and gas operations, it is a known practice to install a well casing into a wellbore that has been drilled into a geologic formation. It is sometimes required that one portion of the wellbore is sealed off from other portions of the wellbore. For this purpose, a setting tool is used to place plugs at locations inside the wellbore. Generally, the setting tool is connected to a gun cluster and is lowered to a desired location within the wellbore casing. The setting tool may be lowered along with the plug or it may be lowered after the plug. The setting tool includes a power charge which, when ignited, causes the plug to expand radially outward, thereby sealing the wellbore, while also separating the setting tool from the plug.

Electrical circuitry within the setting tool sometimes survives ignition of the power charge and remains functional. As a result, electrical signals from the surface may be received and acknowledged by a spent setting tool, presenting false signals regarding whether the setting tool has actuated and whether a retrieved setting tool still has a live charge. Accordingly, there remains a continued need for an improved system that can prevent the return of false signals from a spent setting tool during wellbore completion operations.

SUMMARY OF THE INVENTION

A setting tool adaptor for attachment to a tandem and a setting tool is provided. The setting tool adaptor includes an ignitor within an ignitor cavity and includes an electrically grounded thermal fuse within a logic cavity. The ignitor is adjacent a power charge in a setting tool, such that the ignitor initiates a combustion of the power charge. Pressure and heat generated by the combustion of the power charge ejects the ignitor into the logic cavity and initiates the thermal fuse to render internal circuitry unreadable, while the adjacent tandem isolates the hot gases from an upstream perforating gun or other upstream tool.

In one embodiment, the setting tool adaptor includes a cylindrical body including a central bore. The central bore includes a logic cavity for a thermal fuse and a switch and includes an ignitor cavity for an ignitor. The thermal fuse is electrically grounded to a ground wire within the logic cavity. The ignitor is electrically connected to a contact bolt that extends into the logic cavity, the contact bolt being electrically connected to a detonator wire terminal. In operation, the ignitor converts an electrical signal from the detonator wire terminal into a combustion that initiates a combustion of the adjacent power charge. Pressure generated by the combustion of the power charge forces the ignitor into the logic cavity, and super-heated gases from this combustion activates the thermal fuse to render the switch unreadable.

The setting tool adaptor of the present invention represents a marked improvement over existing technologies which leave the setting tool circuitry undamaged even after detonation of the ignitor. Because the ignitor alone is not able to destroy setting tool circuitry in existing systems, the setting tool circuitry remains detectable by wireline software. The present invention overcomes these and other limitations by ensuring that setting tool circuitry is severed so that it no longer reads. These and other features and advantages of the present invention will become apparent from the following description of the invention, when viewed in accordance with the accompanying drawings and appended claims.

BRIEF DESCRIPTION OF THE DRAWING

FIG. 1 is a cross-sectional view of a setting tool adaptor in accordance with one embodiment of the present invention.

DETAILED DESCRIPTION

The following detailed description is merely exemplary in nature. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Referring now to FIG. 1, a setting tool adaptor in accordance with one embodiment is illustrated and generally designated 10. The setting tool adaptor 10 includes a cylindrical body 12 defining a central bore 14 extending between a proximal end portion 16 and a distal end portion 18. The proximal end portion 16 is internally threaded for attachment to a tandem 20, and the distal end portion 18 is internally threaded for attachment to a setting tool 100. The central bore 14 extends entirely through the cylindrical body 12 and includes a logic cavity 22 and an ignitor cavity 24. The logic cavity 22 includes an internal diameter that is larger than the internal diameter of the ignitor cavity 24.

Within the logic cavity 22, the setting tool adaptor 10 includes a switch housing 26. The switch housing 26 includes an electrically conductive sleeve, for example a metal tube. The switch housing 26 also includes a first end cap 28 and a second end cap 30. The first end cap 28 and the second end cap 30 are each electrically non-conductive and are axially spaced apart from each other. The first end cap 28 includes an electrically conductive terminal 32 that is coupled to a contact bolt 34. The contact bolt 34 is electrically connected to a detonator wire terminal 36 (via the terminal 32) for receiving electrical signals from an input signal wire 38. An internal fuse 40 is interposed between the first end cap 28 and the second end cap 30, the internal fuse 40 being electrically connected to a ground wire 42.

Within the ignitor cavity 24, the setting tool adaptor 10 includes a go-style ignitor 44. The ignitor 44 is electrically connected to the contact bolt 32 via a compression spring 46 and is movable axially in the proximal direction (left, as shown in FIG. 1) in response to combustion of a power charge in the setting tool. The ignitor cavity 24 includes an annular lip 48 to prevent movement of the ignitor 44 in the proximal direction.

As also shown in FIG. 1, the tandem 20 includes a tandem communications insert 50. The communications insert 50 is secured within a cylindrical opening in the tandem body 52 by interference fit. The tandem 20 includes a pass-through element 58 surrounded by an insulating sleeve 60. The insulating sleeve 60 is formed from a non-conductive material to electrically isolate the pass-through element 58 from the tandem body 52, which is electrically grounded. The communications insert 50 includes at least one O-ring 62 to create a seal with the tandem body 52.

In operation, electrical signals pass through the pass-through element 58 from the surface or an upstream tool. The electrical signals pass to a connector plug 70. The connector plug 70 is generally configured as a banana pin connector plug and includes an outwardly bowed portion that is resiliently deformable. The ignitor 44 converts an electrical signal from the detonator wire terminal 36 into a combustion that initiates a combustion of the power charge in the adjacent setting tool 100. Pressure generated by the combustion of the power charge forces the ignitor 44 into the logic cavity 22, and super-heated gases from the combustion of the power charge initiates the thermal fuse 40 to render the internal switch 80 unreadable.

When combined as shown in FIG. 1, the setting tool adaptor 10 and the tandem 20 comprise an integrated assembly for attachment to a setting tool 100. The tandem 20 effectively isolates hot gases within the setting tool adaptor 10 from an upstream perforating gun. The setting tool adaptor 10 of the present invention represents a marked improvement over existing technologies which leave the internal switch 80 undamaged even after detonation of the ignitor. Because existing ignitors are not able to destroy the switch in existing systems, the switch remains detectable by wireline software. The present invention overcomes this and other limitations by ensuring that the switch is severed and no longer reads.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. An assembly for attachment to a setting tool, the assembly comprising:

a tandem including:

an internal switch, a thermal fuse, the thermal fuse being electrically grounded, and a switch housing comprising an electrically grounded tube; and a setting tool adaptor including:

a cylindrical body defining a central bore extending between a proximal end portion and a distal end portion, the central bore including a logic cavity and an ignitor cavity, the tandem being partially contained within the logic cavity;

an igniter contained within the ignitor cavity, the ignitor being electrically connected to a contact bolt that extends from the tandem into the logic cavity, wherein the contact bolt is electrically connected to a detonator wire terminal;

wherein the ignitor is adjacent a power charge in the setting tool, such that the ignitor converts an electrical signal from the detonator wire terminal into a combustion that initiates a combustion of the power charge, wherein pressure and heat generated by the combustion of the power charge ejects the ignitor into the logic cavity and initiates the thermal fuse to render the internal switch unreadable.

2. The assembly of claim 1, wherein a ground wire is connected to the thermal fuse and the internal switch.

3. The assembly of claim 1, further including a first end cap and a second end cap surrounded by the tube and axially spaced apart from each other.

4. The assembly of claim 3, wherein the first end cap and the second end cap are non-conductive.

5. The setting teel adapter assembly of claim 1, wherein the proximal end portion and the distal end portion of the cylindrical body are internally threaded.

6. The assembly of claim 1, wherein the detonator wire terminal comprises a connectable portion through which electrical signals are conveyed to the ignitor.

7. The assembly of claim 1, wherein the ignitor cavity includes a lesser internal diameter than an internal diameter of the logic cavity.

8. An assembly for attachment to a setting tool, comprising:

a setting tool adaptor of including a cylindrical body defining a central bore extending between a proximal end portion and a distal end portion, the central bore including a logic cavity and an ignitor cavity, the setting tool adaptor including an igniter contained within the ignitor cavity;

a tandem threadably attached to the setting tool adaptor such that the tandem is partially contained within the logic cavity of the setting tool adaptor, the tandem including:

a threaded outer body including first and second female openings, the outer body including a central through-bore interconnecting the first and second female openings;

a tandem communications insert within the central through-bore, the tandem communications insert including a pass-through element surrounded by an insulating sleeve, the pass-through element being electrically conductive and including a first socket opening at a first end thereof and a second socket opening at a second end thereof, wherein a connector plug is received within one of the first and second socket openings of the pass-through element; and an internal switch contained within a switch housing comprising an electrically grounded tube, wherein the ignitor is adjacent a power charge in the setting tool, such that the ignitor converts an electrical signal from tandem into a combustion that initiates a combustion of the power charge, wherein pressure and heat generated by the combustion of the power charge ejects the ignitor into the logic cavity and initiates the thermal fuse to render the internal switch unreadable.

9. The assembly of claim 8, wherein the connector plug conveys electrical signals to a detonator wire terminal of the setting tool adaptor.

10. The assembly of claim 8, wherein the connector plug includes a plurality of resiliently deformable arms that bow radially outward.

11. The assembly of claim 8, wherein the first socket opening and the second socket opening extend only partially through the pass-through element, such that the first socket opening and the second socket opening are physically isolated from each other.

12. The assembly of claim 8, further including a snap ring retainer and a retaining washer to stabilize the tandem communications insert within the central through-bore.

13. The assembly of claim 8, wherein the pass-through element includes a plurality of exterior corrugations aligned with a plurality of annular recesses in the insulating sleeve.

14. The assembly of claim 8, wherein the threaded outer body is formed from an electrically conductive material.

15. The assembly of claim 8, wherein the insulating sleeve is secured within the central through-bore by interference fit.

16. The assembly of claim 8, wherein the central through-bore comprises a counter-bore having a first diameter portion and a second diameter portion, the second diameter portion have a diameter that is less than a diameter of the first diameter portion.

17. The assembly of claim 8, further including a plurality of O-rings disposed between the insulting sleeve and the threaded outer body.

18. The assembly of claim 8, wherein the pass-through element is electrically isolated from the threaded outer body.

19. The assembly of claim 8, wherein the threaded outer body of the tandem is electrically grounded.

20. The assembly of claim 8, wherein the threaded outer body includes first and second externally threaded box ends.

* * * * *